US012054234B1

(12) United States Patent
Powers

(10) Patent No.: US 12,054,234 B1
(45) Date of Patent: Aug. 6, 2024

(54) DUAL PROPELLER ASSEMBLIES AND METHODS

(71) Applicant: Charles S. Powers, Shreveport, LA (US)

(72) Inventor: Charles S. Powers, Shreveport, LA (US)

( * ) Notice: Subject to any disclaimer, the term of this patent is extended or adjusted under 35 U.S.C. 154(b) by 40 days.

(21) Appl. No.: 18/198,493

(22) Filed: May 17, 2023

Related U.S. Application Data

(60) Provisional application No. 63/343,186, filed on May 18, 2022.

(51) Int. Cl.
*B63H 5/10* (2006.01)
*B63H 20/24* (2006.01)
*B63H 23/34* (2006.01)

(52) U.S. Cl.
CPC ..... *B63H 5/10* (2013.01); *B63H 20/245* (2013.01); *B63H 23/34* (2013.01); *B63H 2005/106* (2013.01)

(58) Field of Classification Search
CPC ..... B63H 5/10; B63H 20/245; B63H 23/34; B63H 2005/106
See application file for complete search history.

(56) References Cited

U.S. PATENT DOCUMENTS 3,246,698 A 4/1966 Kiekhaefer
4,212,586 A 7/1980 Aguiar
4,276,036 A 6/1981 Nishida et al.
4,566,855 A 1/1986 Costabile et al.
4,619,584 A 10/1986 Brandt
4,897,058 A 1/1990 McCormick
5,009,621 A 4/1991 Bankstahl et al.
5,759,073 A * 6/1998 Sumino ..... B63H 1/28 440/66
5,766,048 A * 6/1998 Iwashita ..... B63H 20/245 440/89 R (Continued)

*Primary Examiner* — Brandon D Lee
(74) *Attorney, Agent, or Firm* — R. Keith Harrison

(57) ABSTRACT

Dual propeller assemblies for driving engagement by a propeller drive shaft may include at least two propellers having a forward propeller and a rear propeller rearwardly of the forward propeller. The forward propeller may include a forward propeller hub with a forward propeller hub wall having a forward propeller hub outer diameter. A forward propeller hub bore may be formed by the forward propeller hub wall and configured to receive the propeller drive shaft for driving engagement of the forward propeller hub thereby. The forward propeller hub bore may form a passageway for flow of exhaust gas configured to traverse the forward propeller between the propeller drive shaft and the forward propeller hub wall. The rear propeller may include a rear propeller hub with a rear propeller hub wall having a rear propeller hub outer diameter less than the forward propeller hub outer diameter of the forward propeller hub wall of the forward propeller hub. A rear propeller hub bore may be formed by the rear propeller hub wall. The rear propeller hub bore may be configured to receive the propeller drive shaft for driving engagement of the rear propeller hub thereby. The passageway for flow of exhaust gas may be configured to traverse the rear propeller hub wall exterior to the rear propeller hub bore of the rear propeller hub.

20 Claims, 5 Drawing Sheets

(56) References Cited

U.S. PATENT DOCUMENTS 5,791,950 A * 8/1998 Weronke ..... F01N 13/12
440/75
9,914,515 B1 3/2018 Powers

* cited by examiner

DUAL PROPELLER ASSEMBLIES AND METHODS

CROSS-REFERENCE TO RELATED APPLICATIONS

This application claims the benefit of U.S. provisional application No. 63/343,186, filed May 18, 2022, and entitled DUAL PROPELLER ASSEMBLIES AND METHODS, which provisional application is hereby incorporated by reference herein in its entirety.

FIELD

Illustrative embodiments of the disclosure relate to marine propellers. More particularly, illustrative embodiments of the disclosure relate to dual prop assemblies with different hub size configurations.

SUMMARY

Illustrative embodiments of the disclosure are generally directed to dual propeller assemblies utilizing a larger diameter forward propeller hub with a gas passageway and an aft or rear propeller having a rear propeller hub where at least a portion of the exhaust gas flows over the rear propeller blades and has a barrel diameter appreciably smaller than the gearcase labyrinth seal.

In some embodiments, the propeller assembly may include a forward propeller including a forward propeller hub with a forward propeller hub wall having a forward propeller hub diameter. A forward propeller hub bore may be formed by the forward propeller hub wall. A rear propeller may include a rear propeller hub with a rear propeller hub wall extending from the forward propeller hub of the forward propeller. The rear propeller hub may have a rear propeller hub diameter less than the forward propeller hub diameter of the forward propeller. A rear propeller hub bore may be formed by the rear propeller hub wall of the rear propeller hub.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
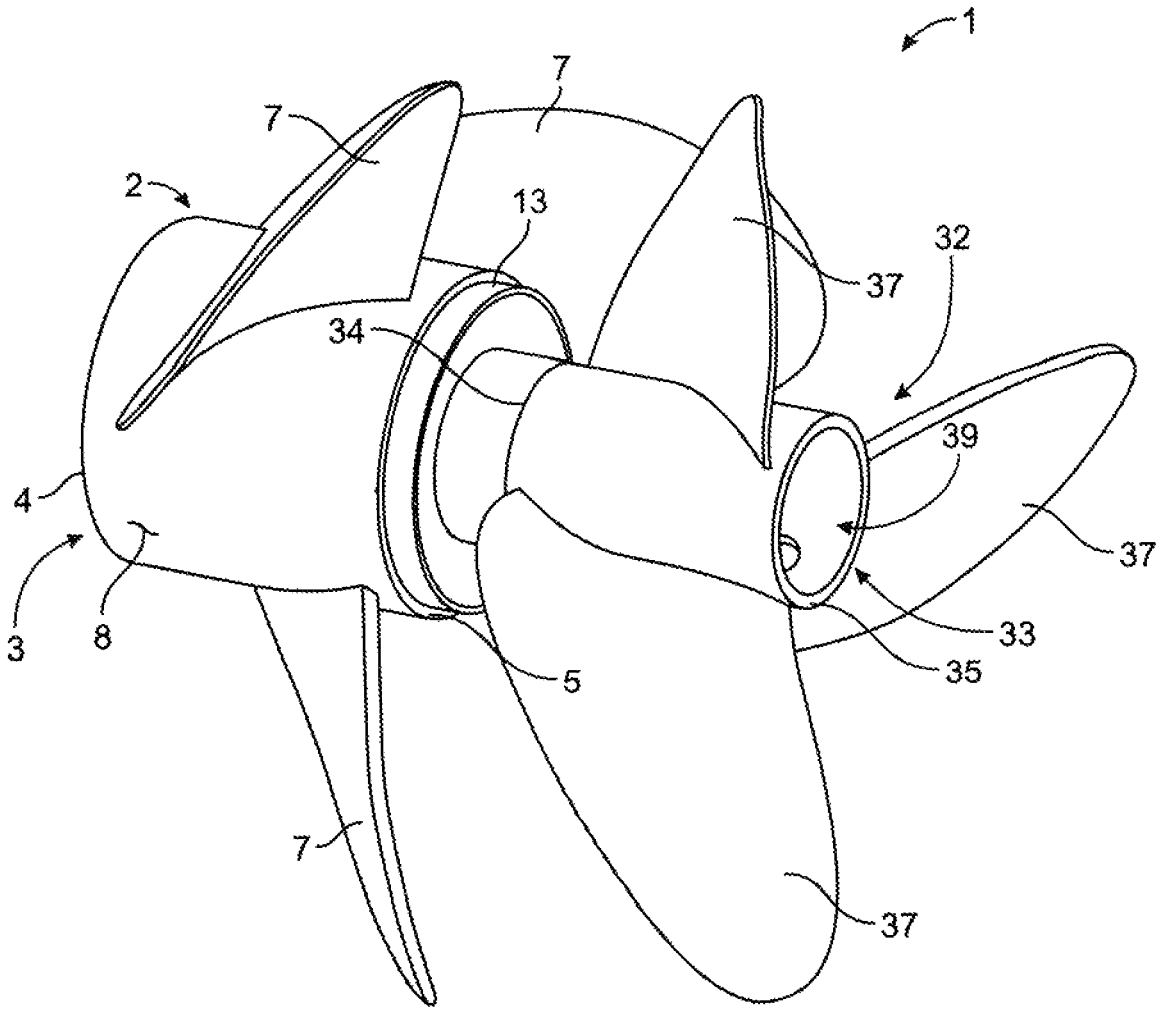
FIG. 1 is a rear perspective view of an illustrative embodiment of the dual propeller assemblies of the disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2A:
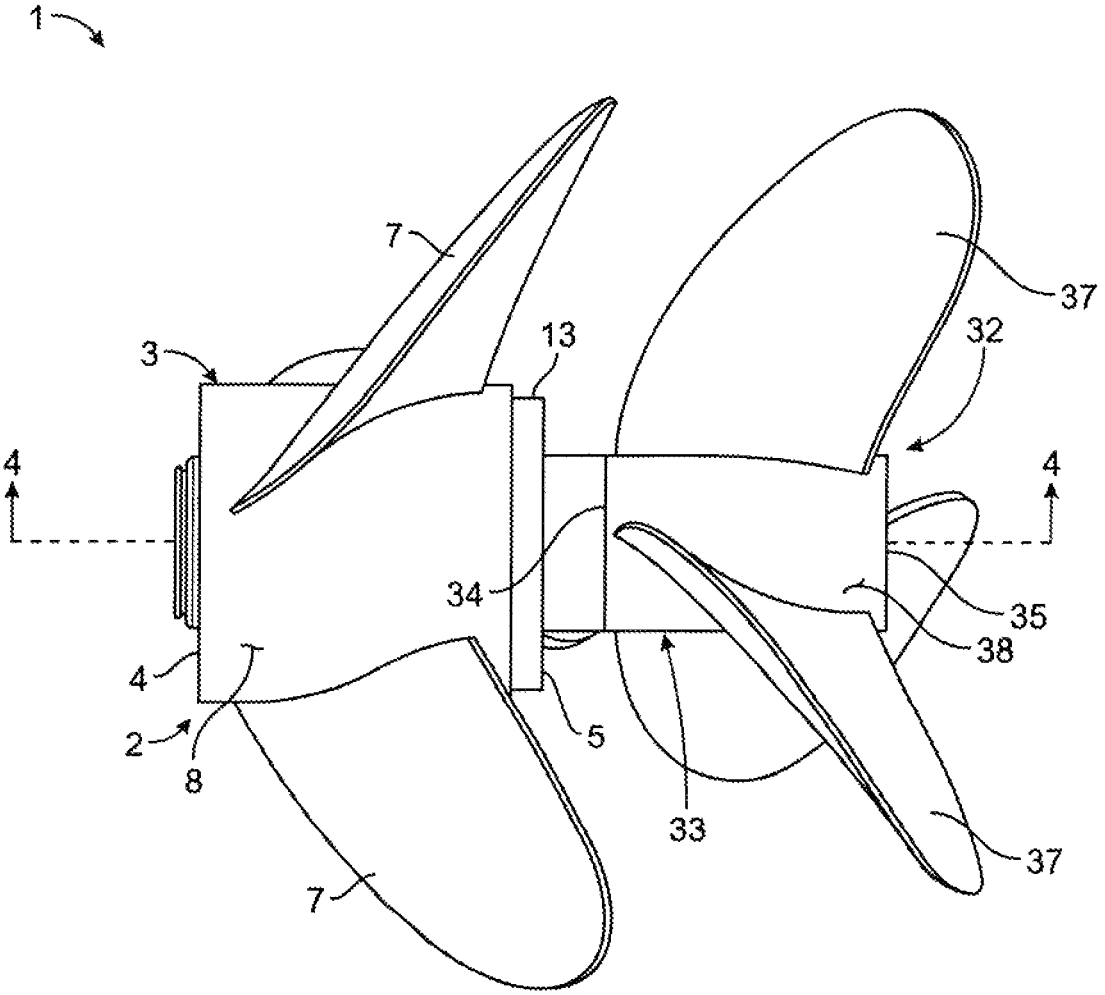
FIG. 2A is a left side view of the illustrative dual propeller assembly shown in FIG. 1.
Figure 2B:
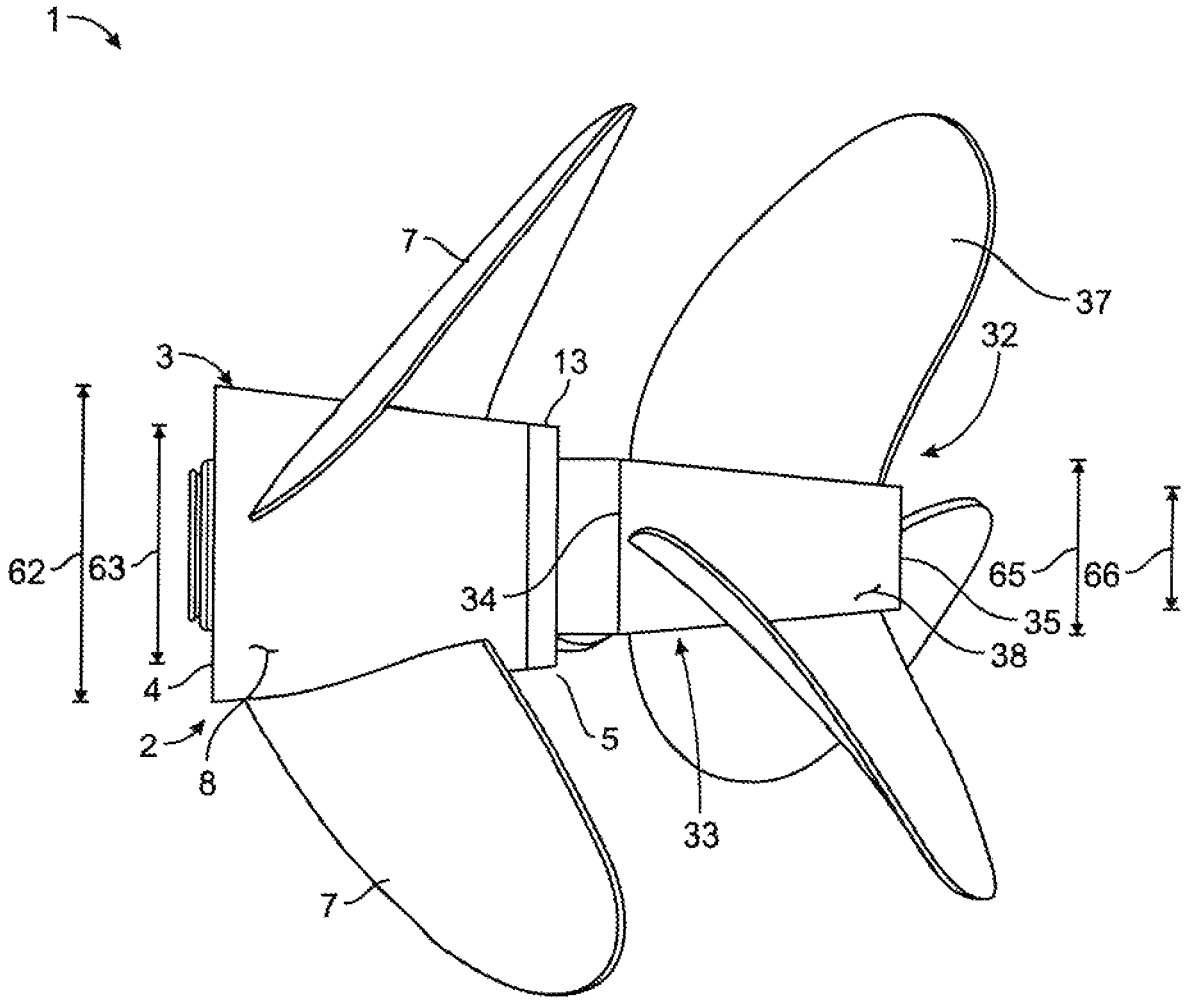
FIG. 2B is a left side view of an illustrative tapered prop embodiment of the dual propeller assemblies.
Figure 3:
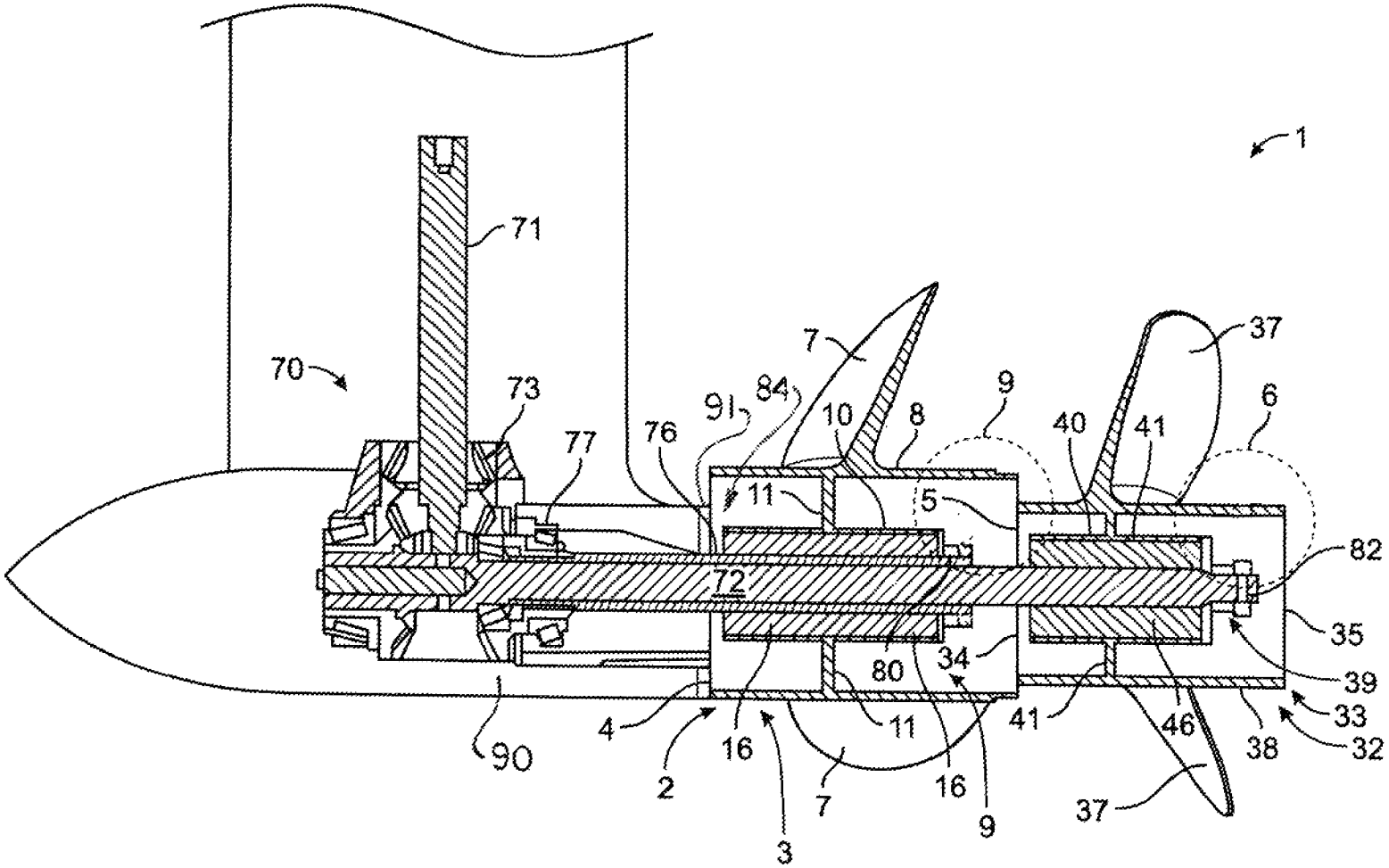
FIG. 3 is a longitudinal sectional view of the illustrative dual propeller assembly, more particularly illustrating a typical propeller drive assembly which is suitable for drivingly coupling the propeller assembly to a main prop drive shaft on a marine vehicle (not shown)

Referring initially to FIGS. 1-5 of the drawings, an illustrative dual prop step down hub embodiment of the propeller assemblies, hereinafter propeller assembly, is generally indicated by reference numeral 1. In typical application, the propeller assembly 1 may be deployed on a marine vehicle (not illustrated) and immersed in a body of water on which the marine vehicle floats to propel the marine vehicle on the water body. As illustrated in FIGS. 1-4, the propeller assembly 1 may include a forward propeller 2 and an aft or rear propeller 32. As illustrated in FIG. 3, the forward propeller 2 may be drivingly engaged by an outer prop drive shaft 76 for rotation in a first clockwise or counterclockwise rotational direction. The rear propeller 32 may be drivingly engaged for rotation in an opposite, second clockwise or counterclockwise direction by an inner prop drive shaft 72 which typically extends through and rotates opposite the outer prop drive shaft 76. Accordingly, by rotation of the forward propeller 2 and the rear propeller 32 in the opposite first and second clockwise and counterclockwise rotational directions, the propeller assembly 1 may propel the marine vehicle forwardly or rearwardly on the water body.

Figure 4:
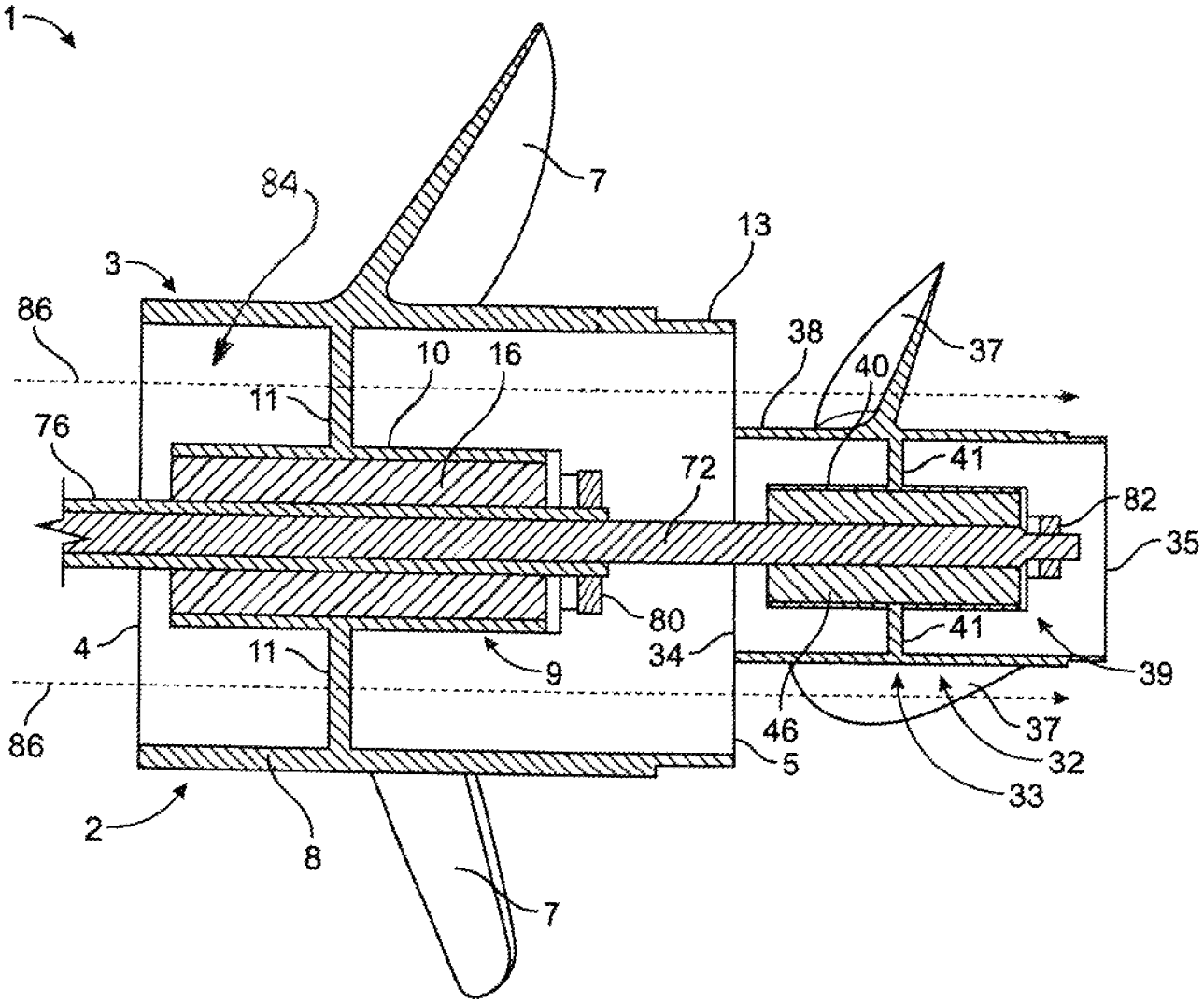
FIG. 4 is an enlarged longitudinal sectional view, taken along section lines 4-4 in FIG. 2A, of the illustrative dual prop propeller assembly illustrated in FIG. 3.

As further illustrated in FIGS. 1-4, the forward propeller 2 of the propeller assembly 1 may have a forward propeller hub 3. The forward propeller hub 3 may have a forward propeller hub wall 8 which may be elongated and generally cylindrical. The forward propeller hub wall 8 may have a fore hub end 4 and an aft hub end 5. As illustrated in FIG. 4, a forward propeller hub bore 9 may be formed by the forward propeller hub wall 8. The forward propeller hub bore 9 may extend through the forward propeller hub 3 from the fore hub end 4 to the aft hub end 5. In some embodiments, an annular forward propeller hub shoulder 13 may be provided in the exterior surface of the forward propeller hub wall 8 at the aft hub end 5, typically for purposes which will be hereinafter described.

Multiple forward propeller blades 7 may extend outwardly from the forward propeller hub wall 8 of the forward propeller hub 3. The forward propeller blades 7 may be oriented to propel the forward propeller 2 forwardly in the body of water as it rotates in the clockwise or counterclockwise first rotational direction and rearwardly in the body of water as it rotates in the opposite clockwise or counterclockwise first rotational direction.

As further illustrated in FIG. 4, a forward propeller drive adaptor 16 may be drivingly engaged for rotation, typically via a splined connection, by the outer propeller drive shaft 76. A forward hub drive sleeve 10 may be disposed in the forward propeller hub bore 9 of the forward propeller 2. Forward hub sleeve vanes 11 may mount the forward hub drive sleeve 10 to the forward propeller hub wall 8. The forward hub drive sleeve 10 may be drivingly engaged for rotation, typically via a splined connection, by the forward propeller drive adaptor 16. Accordingly, rotation of the forward propeller 2 in the first rotational direction may be transmitted from the outer propeller drive shaft 76 to the forward propeller hub 3 and the forward propeller blades 7 of the forward propeller hub 2 via the forward propeller drive adaptor 16, forward hub drive sleeve 10 and forward hub sleeve vanes 11, respectively. In some embodiments, a front prop nut 80 may secure the forward propeller hub 3 of the forward propeller 2 to the outer propeller drive shaft 76.

The rear propeller 32 of the propeller assembly 1 may have a rear propeller hub 33. The rear propeller hub 33 may have a rear propeller hub wall 38 which may be elongated and generally cylindrical. The rear propeller hub wall 38 may have a fore hub end 34 and an aft hub end 35. As illustrated in FIG. 4, a rear propeller hub bore 39 may extend through the rear propeller hub 33 from the fore hub end 34 to the aft hub end 35. Multiple rear propeller blades 37 may extend outwardly from the rear propeller hub wall 38 of the rear propeller hub 33.

As further illustrated in FIG. 4, a rear propeller drive adaptor 46 may be drivingly engaged for rotation, typically via a splined connection, by the inner propeller drive shaft 72. A rear hub drive sleeve 40 may be disposed in the rear propeller hub bore 39 of the rear propeller 32. Rear hub sleeve vanes 41 may mount the rear hub drive sleeve 40 to the rear propeller hub wall 38. The rear hub drive sleeve 40 may be drivingly engaged for rotation, typically via a splined connection, by the rear propeller drive adaptor 46. Accordingly, rotation may be transmitted from the inner propeller drive shaft 72 to the rear propeller hub 33 and rear propeller blades 37 of the rear propeller 32 via the rear propeller drive adaptor 46, the rear hub drive sleeve 40 and the rear hub sleeve vanes 41, respectively. In some embodiments, a rear prop nut 82 may secure the rear propeller hub 33 of the rear propeller 32 to the inner propeller drive shaft 72.

Figure 5:
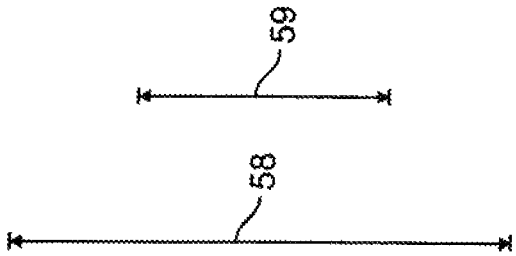
FIG. 5 is a diagram illustrating a typical diameter difference between a forward propeller hub diameter and a rear propeller hub diameter of a forward propeller and a rear propeller, respectively, of the dual prop propeller assembly.

As illustrated in FIGS. 4 and 5, the aft hub end 5 of the forward propeller 2 may have a forward prop hub outer diameter (OD) 58 which is larger than a rear prop hub outer diameter (OD) 59 at the fore hub end 34 of the rear propeller 32. In some embodiments, the rear prop hub diameter 59 of the rear propeller 32 may be about 20%-50% less than the forward prop hub diameter 58 of the forward propeller 2. Typically, the rear prop hub diameter 59 of the rear propeller 32 may be about 50% less than the forward prop hub diameter 58 of the forward propeller 2.

An illustrative tapered prop embodiment of the dual prop apertured propeller assemblies 1 is illustrated in FIG. 2B. Accordingly, one or both of the forward propeller hub 3 of the forward propeller 2 and the rear propeller hub 33 of the rear propeller 32 may be tapered in the fore to aft direction. The same description which was set forth herein above with respect to the dual propeller assembly 1 in FIG. 2A may be applicable to the flared prop embodiment of the dual prop apertured propeller assemblies 1 in FIG. 2B and is incorporated by reference herein in its entirety. The fore hub end 4 and the aft hub end 5 of the forward propeller hub 3 may have a forward hub fore end diameter 62 and a forward hub aft end diameter 63, respectively. The fore hub end 34 and the aft hub end 35 of the rear propeller hub 33 may have a rear hub fore end diameter 65 and a rear hub aft end diameter 66, respectively. In some embodiments, the forward hub fore end diameter 62 may be greater than the forward hub aft end diameter 63 of the forward propeller hub 3. Additionally or alternatively, the rear hub fore end diameter 65 may be greater than the rear hub aft end diameter 66 of the rear propeller 32. In some embodiments, the average difference in diameter from the fore hub end 4 to the aft hub end 5 of the tapered forward propeller hub 3 of the forward propeller 2, or the diameter difference between the forward hub fore end diameter 62 and the forward hub aft end diameter 63, may be 50%. Likewise, the average difference in diameter from the fore hub end 34 to the aft hub end 35 of the tapered rear propeller hub 33 of the rear propeller 32, or the diameter difference between the rear hub fore end diameter 65 and the rear hub aft end diameter 66, may be 50%.

As illustrated in FIG. 3, a typical propeller drive assembly 70 which is suitable for rotating the forward propeller 2 and the rear propeller 32 of the propeller assembly 1 is shown. The propeller drive assembly 70 may include a main propeller drive shaft 71. The main propeller drive shaft 71 may be drivingly engaged for rotation by a motor (not illustrated) on the marine vehicle, typically in the conventional manner. An outer shaft drive gear 77 may be drivingly engaged for rotation by the main propeller drive shaft 71. The outer propeller drive shaft 76 may be drivingly engaged for rotation by the outer shaft drive gear 77. Accordingly, responsive to operation of the motor of the marine vehicle, the main propeller drive shaft 71 may rotate the forward propeller 2 in the first rotational direction through the outer shaft drive gear 77, the outer propeller drive shaft 76, the forward propeller drive adaptor 16, the forward hub drive sleeve 10 and the forward hub sleeve vanes 11, respectively.

As further illustrated in FIG. 3, the inner propeller drive shaft 72 may extend through and terminate beyond the distal or extending end of the outer propeller drive shaft 76. An inner shaft drive gear 73 may be drivingly engaged for rotation by the main propeller drive shaft 71. The inner propeller drive shaft 72 may be drivingly engaged for rotation by the inner shaft drive gear 73 in the second rotational direction as the outer propeller drive shaft 76 is rotated in the typically opposite, first rotational direction. Accordingly, responsive to operation of the motor of the marine vehicle, the main propeller drive shaft 71 may rotate the rear propeller 32 in the second rotational direction through the inner shaft drive gear 73, the inner propeller drive shaft 72, the rear propeller drive adaptor 46, the rear hub drive sleeve 40 and the rear hub sleeve vanes 41, respectively. It will be recognized and understood by those skilled in the art that a variety of alternative propeller drive assemblies 70 having various components and configurations are possible for simultaneously rotating the outer propeller drive shaft 76 and the inner propeller drive shaft 72 typically in the opposite clockwise and counterclockwise directions. For example and without limitation, a propeller drive assembly 70 which may be suitable for the purpose is described in U.S. Pat. No. 10,106,236, which is hereby incorporated by reference herein in its entirety.

The inner shaft drive gear 73 and the outer shaft drive gear 77 may be housed inside a gearcase 90. A gearcase labyrinth seal 91 may be disposed between the forward propeller 2 and the gearcase 90. The fore hub end 4 of the forward propeller 2 may interface with the gearcase labyrinth seal 91. The forward prop hub diameter 58 (FIG. 5) may correspond to the diameter of the gearcase labyrinth seal 91.

In typical application, the dual prop propeller assembly 1 may be assembled on the marine vehicle (not illustrated) to propel the marine vehicle on a body of water. Accordingly, the forward propeller 2 and the rear propeller 32 of the propeller assembly 1 may be disposed in driving engagement with the inner propeller drive shaft 72 and the outer propeller drive shaft 76, respectively, typically as was heretofore described. The propeller assembly 1 may be immersed in the body of water as the marine vehicle is placed thereon. Responsive to operation of the motor (not illustrated) of the marine vehicle, the main propeller drive shaft 71 of the propeller drive assembly 70 may simultaneously rotate the outer propeller drive shaft 76 and the inner propeller drive shaft 72 in the respective first and second clockwise and counterclockwise rotational directions. The front propeller 2 and the rear propeller 32 may responsively rotate in the respective corresponding first and second rotational directions as the forward propeller blades 7 on the forward propeller 2 and the rear propeller blades 37 on the rear propeller 32 propel the propeller assembly 1 and the marine vehicle on the water.

As illustrated in FIG. 4, a passageway 84 for flow of exhaust gas 86 (FIG. 3) from the motor of the marine vehicle may be routed into the body of water through the forward propeller hub bore 9 of the forward propeller 2 and over the exterior of the rear propeller hub 33 of the rear propeller 32. Accordingly, either none or a small quantity of the exhaust gas 86 may traverse the forward propeller hub 3 exterior to the forward propeller hub wall 8 of the forward propeller 2, with all or a substantial portion of the exhaust gas 86 traversing the forward propeller hub bore 9 along the passageway 84 (FIG. 4) for the motor exhaust 86. The passageway 84 for flow of the motor exhaust 86 typically may be either completely exterior to the rear propeller hub wall 38 of the rear propeller hub 33 or may be split partially over the rear propeller blades 37 with the balance going through smaller exhaust passageways (not illustrated) in the rear propeller hub bore 39. As illustrated in FIG. 4, because the rear propeller hub outer diameter 59 (FIG. 5) of the rear propeller 32 is less than the diameter of the gearcase labyrinth seal 91 (FIG. 3) between the gearcase 90 and the fore hub end 4 of the forward propeller 2, all the motor exhaust 86 is incapable of flowing through the internal passageways in the rear propeller hub bore 39 of the rear propeller 32.

It will be appreciated by those skilled in the art that the dual prop embodiment of the propeller assembly 1 may eliminate or substantially minimize steering torque to the marine vehicle since the rotational forces of the forward propeller 2 and the rear propeller 32 largely offset each other. The propeller assembly 1 may provide several advantages over standard or conventional dual prop designs. For example, in conventional dual props in which the forward propeller and the rear propeller have the same outer hub diameters basically matching the gearcase diameter (commonly known as through hub propeller style with an integral internal exhaust passageway), the extended running surface of the propeller hubs may tend to create a pronounced ski effect, causing the marine vehicle to run stern high. On marine vehicles which require a bow high running attitude, this extended running surface may lead to handling and performance issues. Moreover, the conventional method of routing the motor exhaust over the forward and rear propellers of like hub diameter (known typically as an overhub exhaust type propeller with no internal passageway) tends not to restrain the exhaust, but rather, routes the exhaust onto the blade surfaces, thus tending to produce ventilation, especially in initial planing and high speed cornering maneuvers of the marine vehicle. The dual prop propeller assembly 1 may utilize a through hub exhaust forward propeller 2 having the relatively large forward propeller hub diameter 58 (FIG. 5), coupled with an overhub exhaust rear propeller 32 having the relatively smaller rear propeller hub diameter 59, as was heretofore described with respect to FIG. 4. This reduction of running surface from the relatively large forward propeller hub diameter 58 to the relatively smaller rear propeller hub diameter 59 may allow the stern of the marine vehicle to settle appreciably, improving bow lift and hull efficiencies on marine vehicles having hulls with this type of hydrodynamic design. Notably, since it may be a full-size propeller hub with no exhaust gas flowing over the exterior hub, the forward propeller 2 may bite into clean water, thereby producing a significant increase in holeshot or planing and improvement in handling and high-speed cornering when compared to the conventional two over-hub exhaust props.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A propeller assembly for driving engagement by at least one propeller drive shaft, comprising:

at least two propellers comprising:

a forward propeller comprising:

a forward propeller hub with a forward propeller hub wall having a forward propeller hub outer diameter;

a forward propeller hub bore formed by the forward propeller hub wall and configured to receive the propeller drive shaft for driving engagement of the forward propeller hub thereby, the forward propeller hub bore forming a passageway for flow of exhaust gas configured to traverse the forward propeller between the propeller drive shaft and the forward propeller hub wall; and a plurality of forward propeller blades extending from the forward propeller hub wall; and a rear propeller disposed rearwardly of the forward propeller, the rear propeller comprising:

a rear propeller hub with a rear propeller hub wall having a rear propeller hub outer diameter less than the forward propeller hub outer diameter of the forward propeller hub wall of the forward propeller hub;

a rear propeller hub bore formed by the rear propeller hub wall and configured to receive the propeller drive shaft for driving engagement of the rear propeller hub thereby, the passageway for flow of exhaust gas configured to traverse the rear propeller hub wall exterior and to the rear propeller hub bore of the rear propeller hub; and a plurality of rear propeller blades extending from the rear propeller hub wall.

2. The propeller assembly of claim 1 wherein at least one of the forward propeller hub wall of the forward propeller hub and the rear propeller hub wall of the rear propeller hub is tapered.

3. The propeller assembly of claim 2 wherein each of the forward propeller hub wall of the forward propeller hub and the rear propeller hub wall of the rear propeller hub is tapered.

4. The propeller assembly of claim 3 wherein the forward propeller hub wall of the forward propeller hub has a fore hub end with a forward hub fore end diameter and an aft hub end with a forward hub aft end diameter, and difference in diameter between the forward hub fore end diameter and the forward hub aft end diameter is 50%; and wherein the rear propeller hub wall of the rear propeller hub has a fore hub end with a rear hub fore end diameter and an aft hub end with a rear hub aft end diameter, and difference in diameter between the rear hub fore end diameter and the rear hub aft end diameter is 50%.

5. The propeller assembly of claim 1 wherein the rear propeller hub outer diameter of the rear propeller is about 20%-50% less than the forward propeller hub outer diameter of the forward propeller.

6. The propeller assembly of claim 5 wherein the rear propeller hub outer diameter of the rear propeller is about 50% less than the forward propeller hub outer diameter of the forward propeller.

7. The propeller assembly of claim 1 wherein the passageway for flow of the exhaust gas is completely exterior to the rear propeller hub wall of the rear propeller hub.

8. The propeller assembly of claim 1 wherein the passageway for flow of the exhaust gas is split partially over the rear propeller blades of the rear propeller and through the rear propeller hub bore of the rear propeller.

9. A propeller assembly for driving engagement by a propeller drive assembly having a main propeller drive shaft and an outer propeller drive shaft and an inner propeller drive shaft drivingly engaged for rotation by the main propeller drive shaft, the propeller assembly comprising:

at least two propellers comprising:

a forward propeller configured for driving engagement by the outer propeller drive shaft, the forward propeller comprising:

a forward propeller hub with a forward propeller hub wall having a forward propeller hub outer diameter;

a forward propeller hub bore formed by the forward propeller hub wall and configured to receive the outer propeller drive shaft for driving engagement of the forward propeller hub thereby, the forward propeller hub bore forming a passageway for flow of exhaust gas configured to traverse the forward propeller between the outer propeller drive shaft and the forward propeller hub wall; and a plurality of forward propeller blades extending from the forward propeller hub wall; and a rear propeller disposed rearwardly of the forward propeller and configured for driving engagement by the inner propeller drive shaft, the rear propeller comprising:

a rear propeller hub with a rear propeller hub wall having a rear propeller hub outer diameter about 20%-50% less than the forward propeller hub outer diameter of the forward propeller hub wall of the forward propeller hub;

a rear propeller hub bore formed by the rear propeller hub wall and configured to receive the inner propeller drive shaft for driving engagement of the rear propeller hub thereby, the passageway for flow of exhaust gas configured to traverse the rear propeller hub wall exterior and to the rear propeller hub bore of the rear propeller hub; and a plurality of rear propeller blades extending from the rear propeller hub wall.

10. The propeller assembly of claim 9 wherein at least one of the forward propeller hub wall of the forward propeller hub and the rear propeller hub wall of the rear propeller hub is tapered.

11. The propeller assembly of claim 10 wherein each of the forward propeller hub wall of the forward propeller hub and the rear propeller hub wall of the rear propeller hub is tapered.

12. The propeller assembly of claim 11 wherein the forward propeller hub wall of the forward propeller hub has a fore hub end with a forward hub fore end diameter and an aft hub end with a forward hub aft end diameter, and difference in diameter between the forward hub fore end diameter and the forward hub aft end diameter is 50%; and wherein the rear propeller hub wall of the rear propeller hub has a fore hub end with a rear hub fore end diameter and an aft hub end with a rear hub aft end diameter, and difference in diameter between the rear hub fore end diameter and the rear hub al end diameter is 50%.

13. The propeller assembly of claim 9 wherein the rear prop hub outer diameter of the rear propeller is about 50% less than the forward prop hub outer diameter of the forward propeller.

14. The propeller assembly of claim 9 wherein the passageway for flow of the exhaust gas is completely exterior to the rear propeller hub wall of the rear propeller hub.

15. The propeller assembly of claim 9 wherein the passageway for flow of the exhaust gas is split partially over the rear propeller blades of the rear propeller and the rear propeller hub bore of the rear propeller.

16. The propeller assembly of claim 9 further comprising a front prop nut configured for securing the forward propeller on the outer propeller drive shaft and a rear prop nut configured for securing the rear propeller on the inner propeller drive shaft of the propeller drive assembly.

17. A propeller assembly for driving engagement by a propeller drive assembly having a main propeller drive shaft and an outer propeller drive shaft and an inner propeller drive shaft drivingly engaged for rotation by the main propeller drive shaft, the propeller assembly comprising:

at least two propellers comprising:

a forward propeller configured for driving engagement by the outer propeller drive shaft, the forward propeller comprising:

a forward propeller hub with a forward propeller hub wall having a forward propeller hub outer diameter;

a forward propeller hub bore formed by the forward propeller hub wall and configured to receive the outer propeller drive shaft for driving engagement of the forward propeller hub thereby, the forward propeller hub bore forming a passageway for flow of exhaust gas configured to traverse the forward propeller between the outer propeller drive shaft and the forward propeller hub wall; and a plurality of forward propeller blades extending from the forward propeller hub wall; and a rear propeller disposed rearwardly of the forward propeller and configured for driving engagement by the inner propeller drive shaft, the rear propeller comprising:

a rear propeller hub with a rear propeller hub wall having a rear propeller hub outer diameter about 50% less than the forward propeller hub outer diameter of the forward propeller hub wall of the forward propeller hub;

a rear propeller hub bore formed by the rear propeller hub wall and configured to receive the inner propeller drive shaft for driving engagement of the rear propeller hub thereby, the passageway for flow of exhaust gas configured to traverse the rear propeller hub wall exterior and to the rear propeller hub bore of the rear propeller hub; and a plurality of rear propeller blades extending from the rear propeller hub wall.

18. The propeller assembly of claim 17 wherein each of the forward propeller hub wall of the forward propeller hub and the rear propeller hub wall of the rear propeller hub is tapered, the forward propeller hub wall of the forward propeller hub having a fore hub end with a forward hub fore end diameter and an aft hub end with a forward hub aft end diameter, and difference in diameter between the forward hub fore end diameter and the forward hub aft end diameter is 50%; and wherein the rear propeller hub wall of the rear propeller hub has a fore hub end with a rear hub fore end diameter and an aft hub end with a rear hub aft end diameter, and difference in diameter between the rear hub fore end diameter and the rear hub aft end diameter is 50%.

19. The propeller assembly of claim 17 wherein the passageway for flow of the exhaust gas is completely exterior to the rear propeller hub wall of the rear propeller hub.

20. The propeller assembly of claim 17 wherein the passageway for flow of the exhaust gas is split partially over the rear propeller blades of the rear propeller and the rear propeller hub bore of the rear propeller.

* * * * *